United States Patent [19]

Siwinski

[11] Patent Number: 4,747,787

[45] Date of Patent: May 31, 1988

[54] RIBBON CABLE CONNECTOR

[75] Inventor: Paul P. Siwinski, Seminole, Fla.

[73] Assignee: AMP Incorporated, Harrisburg, Pa.

[21] Appl. No.: 23,760

[22] Filed: Mar. 9, 1987

[51] Int. Cl.[4] ..... H01R 13/652

[52] U.S. Cl. ..... 439/108; 439/497; 439/874

[58] Field of Search ..... 439/92, 101, 108, 494, 439/495, 497, 499, 874, 875

[56] References Cited

U.S. PATENT DOCUMENTS

| | | | |
|---|---|---|---|
| 3,416,126 | 12/1968 | Calevich et al. | 439/874 |
| 3,434,094 | 3/1969 | Walter | 339/17 |
| 3,448,345 | 6/1969 | Koehler et al. | 339/14 R |
| 3,634,814 | 1/1972 | Inacker | 339/17 LM |
| 3,643,201 | 2/1972 | Harwood | 339/14 R |
| 3,651,432 | 3/1972 | Henschen et al. | 333/33 |
| 3,689,865 | 9/1972 | Pierini et al. | 339/17 L |
| 3,871,728 | 3/1975 | Goodman | 339/14 R |
| 3,902,777 | 9/1975 | Anhalt et al. | 339/17 C |
| 3,984,166 | 10/1976 | Hutchison | 339/17 CF |
| 4,035,050 | 7/1977 | Volinskie | 439/494 |
| 4,040,704 | 8/1977 | Huber | 339/99 R |
| 4,040,705 | 8/1977 | Huber | 339/99 R |
| 4,094,564 | 6/1978 | Cacolici | 439/494 |
| 4,094,566 | 6/1978 | Dola et al. | 339/14 R |
| 4,133,592 | 1/1979 | Cobaugh et al. | 339/17 M |
| 4,140,360 | 2/1979 | Huber | 339/176 MF |
| 4,163,598 | 8/1979 | Bianchi et al. | 339/107 |
| 4,181,384 | 1/1980 | Dola et al. | 339/14 R |
| 4,225,205 | 9/1980 | Sinclair et al. | 439/499 |
| 4,252,397 | 2/1981 | Eigenbrode et al. | 439/874 |
| 4,260,209 | 4/1981 | Zell et al. | 339/14 R |
| 4,269,466 | 5/1981 | Huber | 339/107 |
| 4,331,370 | 5/1982 | Andrews et al. | 339/17 M |
| 4,342,152 | 8/1982 | Taylor | 439/494 |
| 4,352,531 | 10/1982 | Gutter | 339/14 R |
| 4,367,909 | 1/1983 | Shatto, Jr. et al. | 339/14 R |
| 4,403,102 | 9/1983 | Jordan et al. | 174/16 HS |
| 4,406,512 | 9/1983 | Schell | 439/497 |
| 4,415,216 | 11/1983 | Narozny | 439/494 |
| 4,418,972 | 12/1983 | Benasutti | 339/14 R |
| 4,420,201 | 12/1983 | Stephenson | 339/14 R |
| 4,433,886 | 2/1984 | Cassarly et al. | 339/14 R |
| 4,451,099 | 5/1984 | Brecher, Jr. et al. | 339/14 R |
| 4,491,381 | 1/1985 | Hamsher, Jr. et al. | 339/14 R |
| 4,602,831 | 7/1986 | Lockard | 339/14 R |
| 4,616,893 | 10/1986 | Feldman | 339/14 R |

FOREIGN PATENT DOCUMENTS 2163305 2/1986 United Kingdom .

OTHER PUBLICATIONS

AMP Catalog No. 73-177 (Rev. 8-86), "Amp-Latch Ribbon Cable Connector System", pp. 74-78, U.S. patent application Ser. No. 937,797 filed Dec. 4, 1986.

U.S. patent application Ser. No. 733,176 filed May 13, 1985, Teradyne Technical Bulletin 237 (issue date 1-2-9-85).

*Primary Examiner*—John McQuade

*Attorney, Agent, or Firm*—Robert W. Pitts

[57] ABSTRACT

A connector adapted to couple stripped electrically conductive wires of a ribbon cable with the traces of a printed circuit board through a mating connector upstanding from the printed circuit board. The connector comprises a housing formed with a longitudinal central slot adapted to receive an electrically conductive ground bus. The upper end of the bus is adapted to retain stripped ground wires of the ribbon cable by crimping and soldering. The lower end of the bus is adapted to be received within the mating connector. A plurality of parallel apertures are formed in the housing on opposite sides of the bus to receive signal contacts the upper ends of which are adapted to retain stripped signal wires of the ribbon cable by soldering. The lower ends of the signal contacts are adapted to be received within the mating connector. The connector also includes front and rear cover halves coupleable between the housing and the printed circuit board and adapted to receive and support therebetween the ribbon cable above its stripped wires. Also disclosed is the method of using the connector.

14 Claims, 6 Drawing Sheets

12
10
64
80
76
62
66
78
148
150
114
154
82
124
126
154
54
36
56
34
14
156
70
68
30
32
28
156
16
38

12
10
110
62
120
118
108
66
78
114
122
84
82
92
44
104
98
88
88
68
16
144
72
146
126
96
60
132
136
106
124

RIBBON CABLE CONNECTOR

BACKGROUND OF THE INVENTION

1. Field of the Invention

This invention relates to a connector for a ribbon cable and, more particularly, to a connector for coupling electrically conductive wires of a ribbon cable to traces of a printed circuit board and to a method of using such connector.

2. Description of the Prior Art

The development of new electrical cables in which a large number of wires are encapsulated in a flat insulating web has produced significant advantages in computers, telecommunication devices, and the electronic industry generally. These cables are manufactured with conductors formed as fine parallel wires, as small as 0.030 inches in diameter, located on closely spaced centerlines. They may be used for transmitting electrical power or, in the alternative, electrical signals.

Along with the obvious advantages of size reduction and ease of handling the flat cables per se, such flat cables also present certain disadvantages, both mechanically and electrically. From the mechanical standpoint, the fineness of the wires and the closeness of their spacing generally increase wire handling difficulties during the coupling of the individual wires to other electrical components. as connectors. Further, since their centerline spacings are usually small, they may not necessarily coincide with the standard centerline spacings for commonly used electrical elements thus creating interconnection problems. The development of even smaller cables with finer, more closely spaced wires, further aggravates these mechanical problems in addition to complicating the design of connectors compatible with such further miniaturized cables.

From the electrical standpoint, particularly when flat cables are used for signal transmission purposes, the closeness of wire centerlines dictates their positioning at a specific, precise, constant distance for a particular application if the accurate transmission of signals is to be accomplished. Of equal importance, when flat, multiwire cables are terminated with connectors, such connectors must be designed for controlling the characteristic impedance of the transmitted signals while matching it to the cable as well as the electronic devices being coupled.

The prior art discloses many types of connectors for coupling ribbon cables to a mating connector and electronic device. Note, for example, U.S. Pat. Nos. 4,094,566 to Dola et al; 4,181,384 also to Dola et al; and 4,367,909 to Shatto et al. None, however, discloses a connector or method of use having sufficient utility for its convenient use with ribbon cables formed with conductive wires of 0.008 inches in diameter, several times smaller than those previously employed, cables with wires of a diameter as contemplated by the present invention. Such significantly reduced wire diameters will allow for the proportionate reduction in the spacing between centerlines to 0.0125 inches along with a proportionate increase in the number of wires per cable to 81 wires per linear inch. While U.S. Pat. No. 4,616,893 discloses a connector with controlled characteristic impedance between printed circuit boards, there is no prior art teaching or suggestion of releasable connectors for flat, multi-wire, signal transmission cables with controlled impedance characteristics matching the cable, the mating connector and the electronic devices to be coupled. Lastly, U.S. patent application Ser. No. 661,774 filed Oct. 17, 1984 in the name of Schwalm discloses the soldering of closely spaced wires as of a ribbon cable to connectors. Such disclosure, however, does not teach or suggest the present inventive method and apparatus for coupling ribbon cable wires to the connectors as contemplated herein.

None of these prior art patents teaches or suggests the accurate, efficient, convenient, and economical connector and method as described herein. Known methods and connectors are simply lacking in one regard or another.

As illustrated by the great number of prior patents, efforts are continuously being made in an attempt to more efficiently connect electrical elements of ever decreasing size. None of these prior art efforts, however, suggests the present inventive combination of method steps and component elements arranged and configured for coupling electrical elements as disclosed and claimed herein. Prior methods and connectors do not provide the benefits attendant with the connector and method of the present invention. The present invention achieves its purpose, objectives and advantages over the prior art methods and devices through a new, useful and unobvious combination of method steps and component elements, through the use of a minimum number of functioning parts, at a reduction in cost to manufacture and operate, and through the utilization of only readily available materials and conventional components.

These objects and advantages should be construed as merely illustrative of some of the more prominent features and applications of the present invention. Many other beneficial results can be attained by applying the disclosed invention in a different manner or by modifying the invention within the scope of the disclosure. Accordingly, other objects and advantages as well as a fuller understanding of the invention may be had by referring to the summary and detailed description of the preferred embodiment of the invention in addition to the scope of the invention as defined by the claims taken in conjunction with the accompanying drawings.

SUMMARY OF THE INVENTION

The present invention is defined by the appended claims with the specific preferred embodiment shown in the attached drawings. For the purposes of summarizing the invention, the invention may be incorporated into a connector adapted to couple stripped electrically conductive wires of a ribbon cable with the traces of a printed circuit board through a mating connector upstanding from the printed circuit board. The connector comprises a housing formed with a longitudinal central slot, the slot being adapted to receive an elongated electrically conductive ground bus the upper end of which is adapted to receive stripped groundwires of the ribbon cable and the lower end of which is adapted to be received within the mating connector. The housing has a longitudinal central plane extending through the slot and the bus. A pluralty of parallel apertures are formed in the housing on opposite sides of the central slot. The apertures are adapted to receive signal contacts the upper ends of which are adapted to receive stripped signal wires of the ribbon cable and the lower ends of which are adapted to be received within the mating connector. The housing also has downwardly extending legs defining an opening for receiving the mating connector. The connector also comprises front and rear halves couplable between the housing and the printed circuit board and adapted to receive and support therebetween the ribbon cable above its stripped wires.

Each cover half includes a downwardly projecting first leg with a horizontal, upwardly facing ledge. The connector further includes a pair of side latches couplable with the printed circuit board. Each side latch has an upwardly projecting leg with a horizontal, dowwnardly facing ledge for receiving on the upwardly facing ledges of the cover halves for coupling the cover halves and the housing with respect to the side latches and the printed circuit board. Each cover half has a downwardly projecting second leg, the second legs being located on opposite sides of the longitudinal central plane of the connector and interiorly of the first legs with each second leg having a lower surface positionable upon an internal upper surface of the housing. The connector further includes a space between each first leg and its adjacent second leg to allow each first leg to be moved interiorly toward the second legs for the coupling and uncoupling of the cover halves and the housing with respect to the side latches and printed circuit board. The housing has cut out portions on its front and rear faces and an external upper surface for the receipt of the cover halves. The lower extents of each second leg have face projections extending longitudinally toward the ends of the housing receivable in corresonding face recesses in the housing to preclude upward movement of the cover halves when positioned within the housing. The ends of each cover half have end projections extending longitudinally toward the ends of the housing receivable in corresponding end recesses in the housing to preclude lateral movement of the cover halves when positioned within the housing. The connector further includes internal recesses in the cover halves facing the longitudinal central plane of the connector for receiving the upper portions of the signal contacts and the ground bus as well as the stripped wires of the ribbon cable. The connector further includes means associated with the side latches to couple the side latches to a printed circuit board. The last mentioned means includes a button downwardly extending from each side latch, each button having a cut out to facilitate its contraction and expansion and consequently, its insertion into, its retention in, and its removal from, a hole in a printed circuit board.

The invention may further be incorporated into a combination for coupling wires of a ribbon cable with an electrical connector. The combination comprises signal contacts within the connector. Each signal contact has a downwardly extending U-shaped slot, the bights of the slots having semicircular cross-sectional configurations about parallel horizontal axes with a common first diameter. The combination also comprises signal wires extending parallel with each other in the plane of a ribbon cable. The signal wires have circular cross-sectional configurations with a common second diameter less than the first diameter. The signal wires have stripped free ends with a bend in each signal wire adjacent to its free end of less than 90 degrees from an origonal vertical orientation whereby the bent portion of each signal wire may contact the bight of one the signal contacts adjacent to its end remote from the plane of the ribbon cable. The combination also comprises material coupling each signal wire and its associated signal contact.

The soldering material encompasses at least about 270 degrees of the cross-sectional area of each signal wire. The bend is about 70 degrees. The signal contacts are located on opposite sides of the plane of the ribbon cable and the bends of some of the signal wires are toward the signal contacts on one side of the plane and the bends of others of the signal wires are toward the signal contacts on the other side of the plane. The combination further includes ground wires extending downwardly from the ribbon cable between the signal wires and a ground bus in the plane of the ribbon cable for receiving the ground wires. The ground bus is formed as an electrically conductive U-shaped member with upwardly facing flanged ends. The upper extent of the U-shaped member is adapted to be crimped over the downwardly extending ground wires. The combination further includes soldering material coupling each ground wire to the ground bus.

Further, the invention may be incorporated in a connector releasably couplable with mating connector means. The connector includes a housing fabricated of an electrically insulating material with an opening formed to receive, support, and provide strain relief to the stripped free end of a flat, multi-wire, signal transmission cable. The connector also includes a plurality of spaced, parallel, electrically conductive signal contacts supported by the housing in a first plane and having their first ends within the housing and adapted to receive some wires of the received cable for signal transmission purposes, the signal contacts having second ends releasably couplable with the mating connector means. The connector also includes a blade-like ground bus supported by the housing having a first end within the housing and adapted to receive others of the wires of the received cable for grounding purposes. The ground bus has a second end releasably couplable with the mating connector means, the ground bus being in a second plane parallel with, but offset from, the first plane at a predetermined distance for controlling the impedance characteristics of the transmitted signals through the connector from the first ends of the ground bus and signal contacts to the second ends of the signal contacts and ground bus. The signal contacts are located in two parallel first planes on opposite sides of the ground bus and the second plane with the first planes being equally spaced from the second plane. The ground bus is adapted to receive every other wire of the cable for grounding purposes and the wires of the cable not received by the ground bus are adapted to be received by signal contacts. The second ends of the ground bus and signal contacts extend beyond the housing for insertion into the mating connector means. The connector further includes solder means to couple signal contacts to signal transmitting wires.

In addition, the invention may further be incorporated in a method for coupling electrically conductive wires of a ribbon cable with signal contacts of a connector. The method includes the steps of (1) supporting signal contacts within a connector, each signal contact having a downwardly extending U-shaped slot, the bights of the slots having semicircular cross-sectional configurations about parallel horizontal axes with a common first diameter; (2) providing signal wires extending parallel with each other in the plane of a ribbon cable, the signal wires having circular cross-sectional configurations with a common second diameter less than the first diameter, the signal wires having stripped free ends; (3) bending each signal wire adjacent to its free end less than 90 degrees from an original vertical orientation; (4) supporting, within the connector, the wires with the bent portions contacting the bights of the signal contacts adjacent to their ends remote from the plane of the ribbon cable; and (5) coupling the signal wires to the signal contacts.

The coupling is effected by soldering material deposited into the signal contacts by a technique selected from the class of depositing techniques including plating, printing, silkscreening, dipping and inlaying. The soldering material is preferably deposited by plating the bight of the slot. The soldering material is preferably caused to liquify through reflow soldering. The soldering material is liquified by a technique selected from the class of liquifying techniques including radio frequency, resistance, laser or vapor phase. The soldering material is preferably liquified by radio frequency. The ground bus is formed as a U-shaped metallic member with upwardly facing flanged ends. The method further includes the step of crimping the U-shaped member over the downwardly projecting ground wires. The method further includes the step of soldering the downwardly projecting ground wires to the U-shaped member.

Lastly, the invention may be incorporated in a method of coupling an electrically conductive wire with a signal contact of a connector. The method includes the step of supporting a signal contact within a connector, the signal contact having a downwardly extending U-shaped slot, the bight of the slot having semicircular cross-sectional configuration with a first diameter. The method includes the further step of providing a signal wire, the signal wire having a circular cross-sectional configuration with a second diameter not greater than the first diameter, the signal wiring having a stripped free end. The method includes the step of bending the signal wire adjacent to its free end less than 90 degrees from an original orientation. Further, the method includes the steps of supporting, within the connector, the wire with the bent portion contacting the bight of the signal contact adjacent to one end and adhering the signal wire to the signal contact.

The foregoing has outlined rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art that the conception and the specific embodiment disclosed herein may be readily utilized as a basis for modifying or designing other methods and apparatus for carrying out the same purposes of the present invention. It should also be realized by those skilled in the art that such equivalent methods and apparatus do not depart from the spirit and scope of the present invention as set forth in the appended claims.

BRIEF DESCRIPTION OF THE DRAWINGS

For a more complete understanding of the nature, objects and advantages of the present invention, reference should be had to the following detailed description taken in conjunction with the accompanying drawings in which:

FIG. 3 is a sectional view of the apparatus shown in FIG. 2 taken through the center of the connector, mating connector and ribbon cable.

Similar reference numerals refer to similar parts throughout the several Figures.

DETAILED DESCRIPTION OF THE INVENTION

Figure 1:
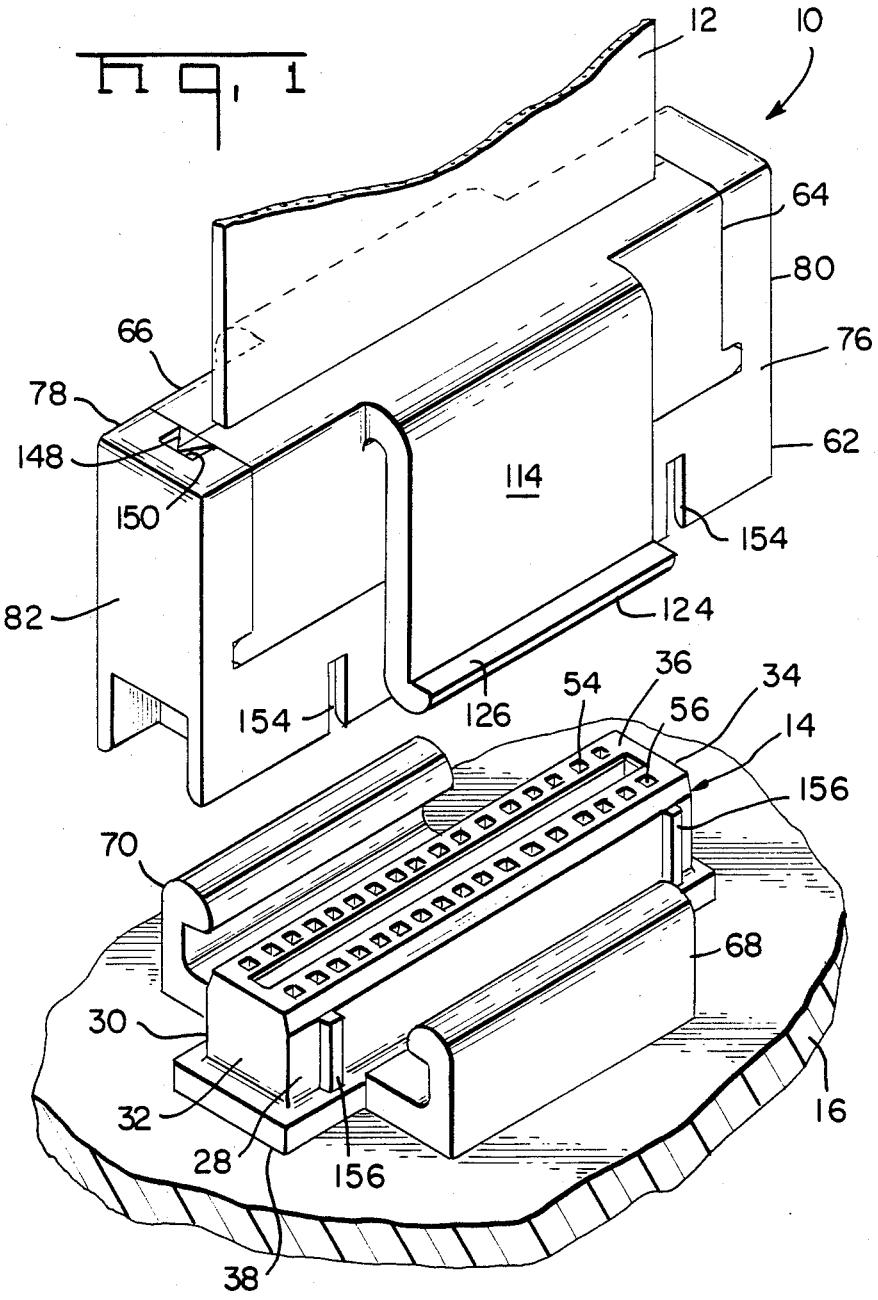
FIG. 1 is a perspective illustration of the present inventive connector supporting a ribbon cable and in a position to be coupled with an associated mating connector.
Figure 2:
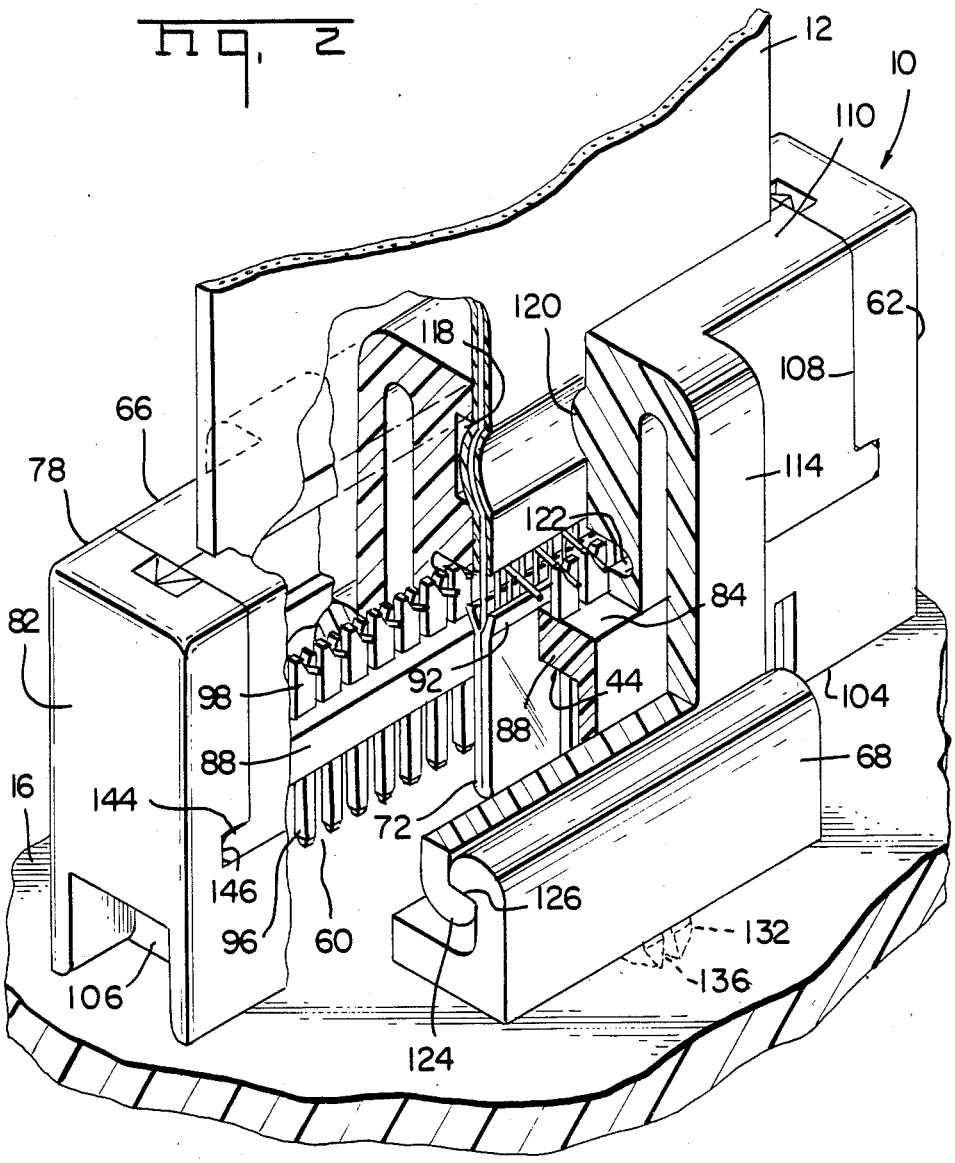
FIG. 2 is a perspective illustration of the present inventive connector as shown in FIG. 1, but with the connector coupled to its mating associated connector and with parts broken away to show certain internal constructions.
Figure 7:
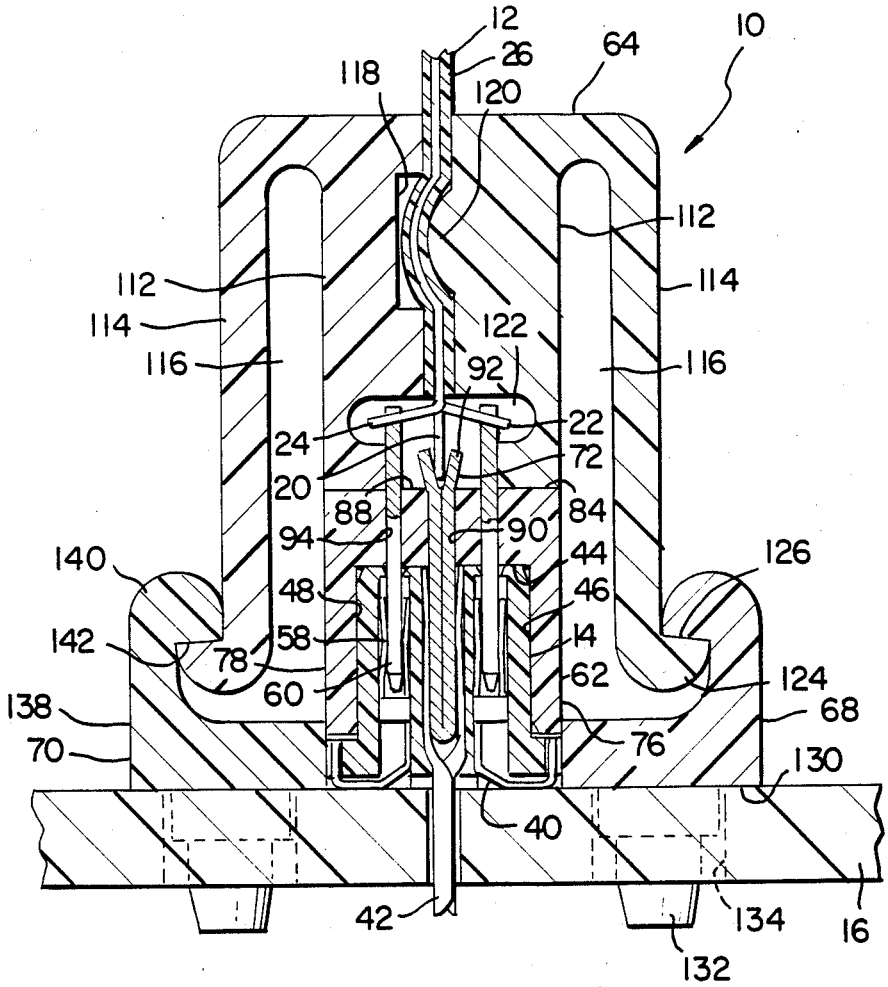
FIGS. 7 and 8 are sectional views of a signal contact and signal wire with solder material therebetween taken along lines 7—7 and 8—8 respectively of FIG. 6.

Shown in the Figures, with particular reference to FIGS. 1 and 2, is an electrical connector 10 embodying the principles of the present invention with parts removed to show certain internal constructions. The connector is shown in combination with the ribbon cable 12 and a mating connector 14 secured to a printed circuit board 16. The ribbon cable is formed as a flat member fabricated of electrically insulative material having a plurality of fine, closely spaced electrical conductive wires 20, 22 and 24 embedded therein. The wires are positioned parallel, one with respect to the other, with the insulative material 26 of the ribbon separating the wires. The ends of the wires within the connector are stripped for appropriate coupling with their associated contacts.

Also shown in FIGS. 1, 2 and 3 is the printed circuit board 16 supporting on its upper surface a mating connector 14 for receiving the connector 10 whereby discrete elements of the mating connector and printed circuit board may interconnect with discrete conductive elements of the cable within the connector. The mating connector 14 is formed with front and rear faces 28 and 30, end faces 32 and 34, and top and bottom surfaces 36 and 38. The bottom surface 38 is supported on the printed circuit board 16. Interconnecting elements 40 are located within the mating connector for attachment to traces on the printed circuit board The top surface 36 and faces 28, 30, 32 and 34 of the mating connector receive a lower surface 44 and interior faces 46 and 48 of the connector. The mating connector 14 also is provided with apertures 54 and 56 extending between the top and bottom surfaces 36 and 38 with electrically conductive receptable connectors 58 for receiving the contacts 60 of the connector 10 for conducting current between the wires 20, 22 and 24 of the ribbon cable 12 and the traces of the printed circuit board 16.

The connector 10 itself is formed of a plurality of connectable component elements formed of an electrically insulative, plastic material. The preferred material is Ultem 1000. Ultem 1000 is a trademark of the General Electric Company. These connectable component elements include the housing 62 adapted to be supported upon the mating connector 14 as well as a front cover half 64 and rear cover half 66 adapted to be received within the housing for securing the ribbon cable with respect to the housing. The connector 10 also includes front and back side latches 68 and 70 for securing the cover halves 64 and 66, and consequently the connector 10 to the printed circuit board 16. The housing 62 is also configured and adapted to support electrically conductive signal contacts 60 and an electrically conductive ground bus 72 in proper position with respect to the ribbon cable 12 and its conductive wires and to provide electrical connections with the electrical conductive segments of the mating connector 14.

As used herein the terms front and rear, upper and lower, horizontal and vertical, and the like are used for descriptive purposes only. It should be readily appreciated that the connector of the present invention could be used in any vertical, horizontal, or angular orientation without departing from the spirit and scope of the invention. Such descriptive language herein should, in no way, be construed as limiting the invention in any manner. In addition, when the ribbon cable is received by the connector, the majority of its extent lies in a plane which is the longitudinal central plane of the connector 10, mating connector 14 and ground bus 72. The terms interior and exterior and the like are intended to be construed with respect to this longitudinal central plane.

With particular reference to FIGS. 1, 2, and 3, the housing 62 is formed of a block-like member with front and rear faces 76 and 78, end faces 80 and 82, and a lower surface 44 and an upper internal surface 84 fabricated into a unitary component member as by molding. The housing includes inwardly projecting shelf-like blocks 88, the upper surfaces of which constitute the upper internal surface 84 of the housing. These blocks extend inwardly toward the longitudinal central plane of the connector and toward each other to form a central slot 90 of such size as to receive a ground contact or bus 72. The bus is a blade-like electrically conductive member formed of an electrically conductive material, preferably metal. It is formed in a tight U-shaped configuration with its free edges 92 extending upwardly and outwardly, flared to a limited degree, for assisting in locating and receiving ground wires 20 of the ribbon cable 12. The lower portion of the ground bus 72 is adapted to be received downwardly into the central slot 90 of the housing and to mechanically and electrically receive selected conductive wires 20 of the ribbon cable, specifically, those wires of the cable intermediate the signal wires which function as electrical grounds. The flare at the upper extent of the bus 72 limits its downward movement into the slot 90.

Also located within the blocks 88 of the housing 62 are vertical apertures 94 adapted to receive signal contacts 60. The signal contacts are formed of an electrically conductive material, preferably metal. They include posts 96 of a rectangular cross-sectional configuration over the majority of their lower lengths. Their upper extents 98 are rectangular in cross-section but enlarged with respect to their lower extents for being received by, and supported upon, the upper surfaces 84 of the blocks 88. Their upper edges are provided with notches 102, perpendicular with respect to the longitudinal central plane of the connector. Each notch has a U-shaped or semicircular lower extent for receiving a signal wire 22 or 24 of the ribbon cable. The lower stripped ends of the ground contact wires 20 and signal contact wires 22 and 24 are thus adapted to be received respectively by the ground contact bus 72 and signal contacts 60 for mechanically and electrically coupling the wires of the cable with the electrically conductive connectors of the mating connector and, hence, to the traces of the printed circuit board, all in a particular predetermined orientation.

The front and rear faces 76 and 78 of the housing are formed with downwardly projecting legs 104. Similarly, downwardly projecting legs 106 are formed in proximity to the ends of the housing. These downwardly projecting legs extend generally peripherally around the housing and are arranged to be slid over the front and rear faces 28 and 30 and ends 32 and 34 of the mating connector 14.

Portions of the top external surface and faces of the housing are formed as cutaways 108 so as to receive the front and rear cover halves. The cover halves are similarly shaped, each with an upper portion 110 positionable proximate the upper external surface of the housing and with two downwardly extending pair of parallel legs 112 and 114. The interior legs 112 are the shorter legs with their interior faces closer to the longitudinal central plane of the connector. Their lower surfaces are supported by an upper internal surface of the housing. The exterior legs 114 are the longer legs with their interior surfaces spaced from the interior legs to create spaces 116 therebetween.

The front and back cover halves are essentially symmetrical with respect to the longitudinal central plane of the connector except for a strain relief recess 118 and a mating strain relief projection 120 adjacent to their upper interior surfaces for receiving and holding the cable 12 to preclude its movement from the connector during operation and use as might occur through inadvertent pulling. Beneath the strain relief elements of the cover halves are additional recesses 122 for accommodating the upper extents of the signal contacts 60 and bus 72 and the lower stripped ends of the wires of the ribbon cable. In operation and use, the end of the ribbon cable supported by the connector is stripped to such extent that its non-stripped portion will be contacted by the strain relief elements of the cover halves for providing the desired restraint from movement. The area of the ribbon cable beneath the strain relief elements will be stripped to such an extent that the stripped ends are located within the additional recesses 122 of the cover halves.

The lower ends of the exterior legs are formed with projections 124 extending exteriorly away from the longitudinal central plane of the housing. The projections include essentially horizontal, upwardly facing, ledges 126 which are employed for fixedly positioning the housing with respect to the printed circuit board during operation and use. Between the interior and exterior legs are the upwardly extending spaces 116 to allow for a limited degree of movement of the exterior legs which, due to their resiliency, accommodate the attachment and removal of the connector from the printed circuit board.

The last component elements of the connector are two similarly configured side latches 68 and 70. The side latches have lower surfaces 130 supported upon the upper surface of the printed circuit board 16 Formed on the lower surface of each side latch is a downwardly projecting attachment button 132 to be received by apertures 134 in the printed circuit board to which the connector is to be secured. At a central extent, each button 132 is provided with an enlarged area with an upwardly facing abutment surface and an axial cutout 136 whereby the lower end of the buttons may be contracted, forced through holes in the printed circuit board, and released to provide a secure mechanical attachment to the printed circuit board for the side latches and hence for the connector and ribbon cable. Contraction of a button 132 at its cutout 136 will allow removal of its side latch from the printed circuit board.

Upwardly extending from the base portions of the side latches are legs 138 formed with projections 140 extending inwardly toward the longitudinal centerline of the housing. The projections include downwardly facing, essentially horizontal ledges 142 which are employed to receive and hold the upwardly facing ledges 126 of the cover halves. The positioning of the cover halves and housing over the mating connector will allow the cover halves to be secured with respect to the side latches for holding the connector in place with respect to the mating connector and printed circuit board.

The lower extents of each of the first or interior legs of each cover half have face projections 144 in the plane of their leg extending longitudinally away from each other and toward the ends of the housing. These projections, a total of four in number, are received in corresponding shaped face recesses 146 in the front and rear faces of the housing. When coupled, the projections and recesses preclude upward and downward movement of the cover halves with respect to the housing. Similarly, the ends of each of the cover halves have outwardly extending end projections 148, four in number, facing away from each other and toward the ends of the housing. These projections are receivable in corresondingly shaped end recesses 150 in the housing. When the cover halves are coupled to the housing, these projections and recesses will preclude lateral movement of the cover halves in a horizontal plane with respect to the housing.

The coupling of the front and rear cover halves 64 and 66 with respect to the connector housing 62 is effected by simply holding the cover halves parallel with each other adjacent to the ribbon cable after the stripped cable ends have been coupled to the signal contacts and the ground bus. While maintaining this parallel relationship, the halves are moved either simultaneously or sequentially toward the ribbon cable. The halves with their end projections 148 will readily snap into the end recesses 150 for proper operational positioning of the cover halves with respect to the housing 62. Removal of the cover halves involves urging the upper portions of the housing outwardly away from each other in the plane of the longitudinal central plane. This action allows the end projections 148 to clear the end recesses 150 as the halves are pulled away from the ribbon cable and housing 62 by a motion reversed with respect to the motion which effected their coupling.

The front face 28 of the mating connector 14 is provided with two upwardly extending spaced parallel plugs 156. Similarly, the front face of the connector housing 62 is formed with two downwardly extending spaced parallel slots 154. The plugs and slots are equally spaced and of substantially the same width to allow the mating of the connector housing 62 with the mating connector. These plugs and slots are located on one face only of the connector housing and mating connector and are in mutually restrictive locations to preclude the improper positioning of the connector housing 62 and connector 10 with respect to the mating connector 14. As a result, it is impossible to couple the connector 10 and mating connector 14 in a reverse orientation.

In the normal mode of operation, every other connector wire 20 of the ribbon cable 12 is a ground for being received by the ground bus 72. Every intermediate connector wire 22 and 24 of the cable is adapted to carry a signal from the cable to the printed circuit board. As such, every signal wire of the cable must be bent outwardly toward an appropriate signal contact 60 on one side or the other of the longitudinal central plane. In this manner, appropriate wires of the ribbon cable may be coupled with appropriate traces of the printed circuit board for accommodating and effecting the intended electronic function of the connector.

Figure 5:
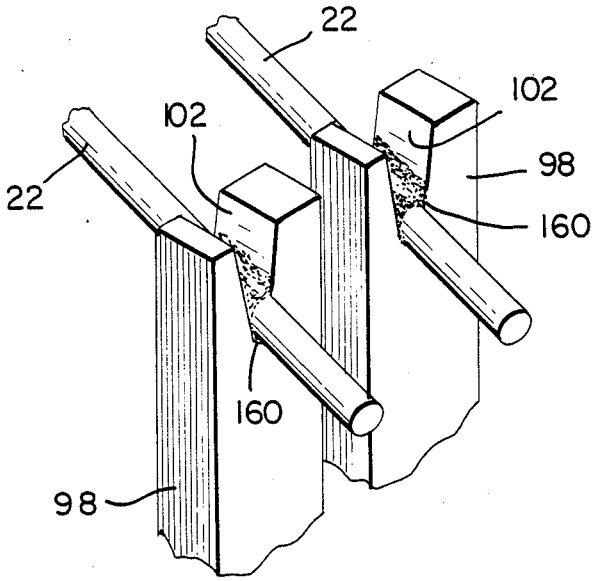
FIG. 5 is a perspective illustration of two signal contact wires and their associated signal contacts and also showing the soldering material effecting the coupling therebetween.
Figure 8:
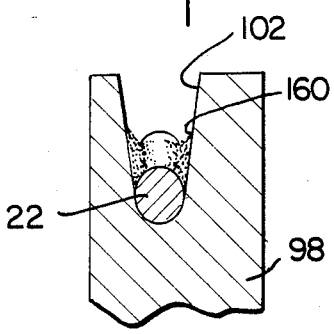

The upper end of the ground bus 72 at the flared section and slightly therebeneath, as well as the U-shaped notches of the signal contacts, are adapted to be coated with a soldering material 160 prior to receiving their appropriate wires. In this manner, when the wires of the ribbon cable are brought into contact with the appropriate sections of the ground bus 72 and signal contacts 60, mechanical contact may be made as shown, for example, in FIGS. 3, 5 and 8. The ground wires are secured into the ground bus through crimping together the upper extent of the ground contact while the ground bus 72 is in slot 90. This is followed by soldering.

The housing, with its ground contacts and signal contacts, connector wires of the cable in proper position, may then be heated as through radio frequency energy to liquify the solder material between the ground bus and ground wires as well as between the signal contacts and signal wires to make secure solder connections therebetween.

Figure 4:
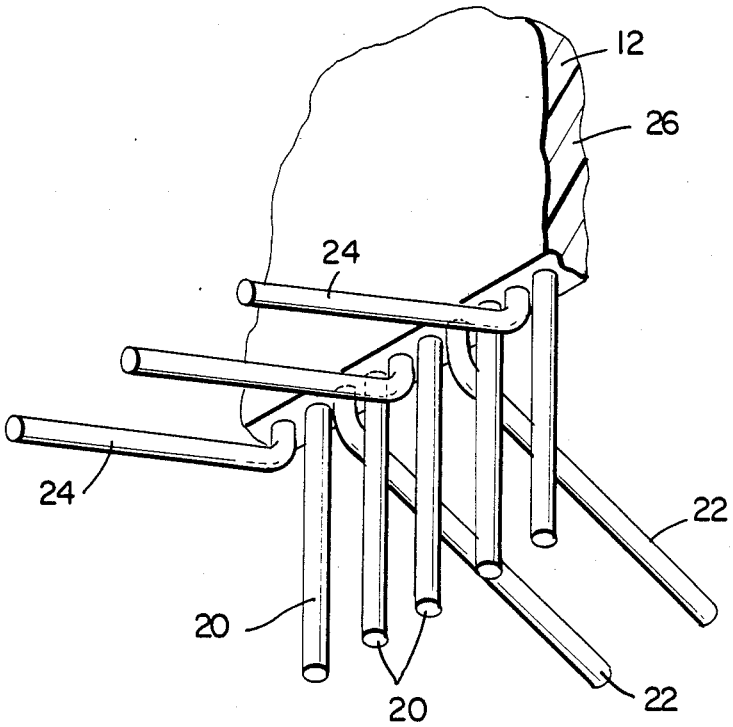
FIG. 4 is an enlarged perspective illustration of the lower end of the ribbon cable as shown in FIGS. 2 and 3 illustrating the ground connector wires and signal contact wires at the end of the ribbon cable.
Figure 6:
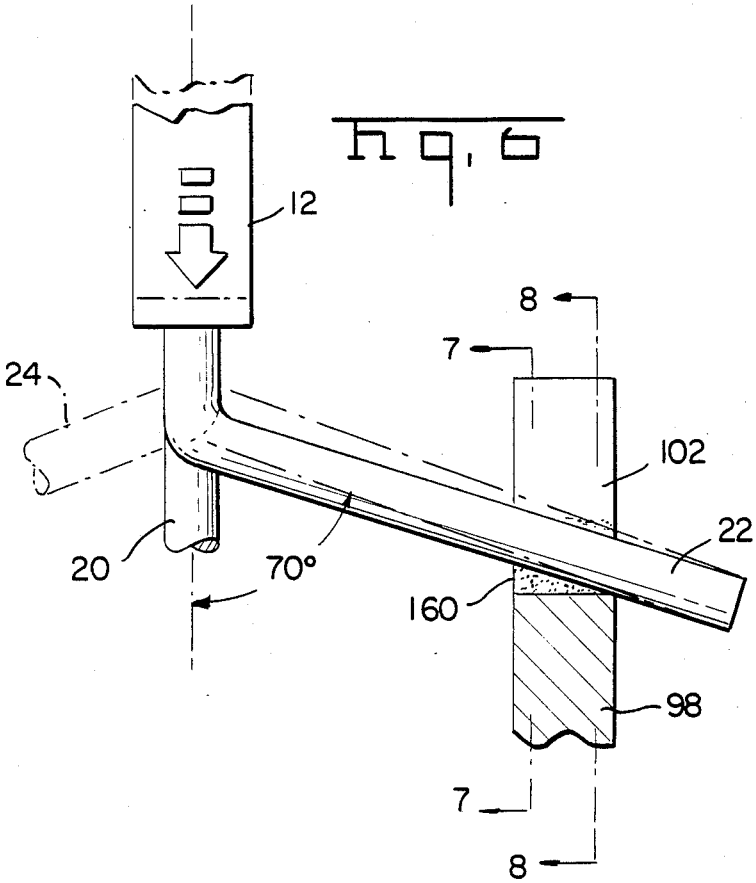
FIG. 6 is a sectional view of a ribbon connector and some of its wires coupled to a signal contact with solder material therebetween, a signal wire being shown in both an initial position and a final position.
Figure 7:
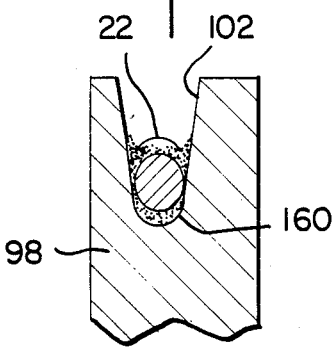

As particularly seen in FIGS. 3, 4 and 6, the signal connector wires of the cable are bent from the vertical slightly less than a full 90 degrees. By bending them at about 70 degrees, their exterior portions remote from the bends will contact an exterior portion of the signal contacts, the edges of the signal contacts remote from the longitudinal central plane. When urged downwardly during coupling, the ends of the signal wires will be forced slightly upwardly by the signal contacts to beyond the desired 70 degrees for insuring complete contact between all of the signal wires and their signal contacts. The deflection upwardly may be between about an additional 5 and 20 degrees, but still preferably below the horizontal or 90 degree orientation. This deflection of the wire insures a secure physical contact between each signal wire and its associated signal contact prior to soldering.

The diameter of the U-shaped slot 102 of the signal contacts 60 is equal to or preferably slightly greater than the diameter of the conductive signal wires 22 and 24 of the ribbon cable 12. The soldering may thus effect an encapsulation of at least about 270 degrees of the wires, for forming a mechanical bond as well as an electrial coupling. In practice, the solder material will often totally encapsulate the entire cross section of the signal wires along their entire lengths. Contrary to previous thoughts, a mechanical wedging action between the wire and slot to be soldered has been found to be unnecessary, and hence the diameter of the wire 22 or 24 is preferably not greater than the width of the slot or the diameter of its bight.

In the preferred embodiment, the solder material may be applied to the appropriate portion or portions of the ground contact and signal contacts by any one of a plurality of techniques including plating, printing, silk-screening, dipping or inlaying. In the preferred embodiment, the solder material is plated onto the upper end of the ground contact and the signal contact to at least cover the U-shaped bight. The soldering may be enhanced by a commercial flux material provided onto the strip wire ends. The solder may be caused to reflow by any one of a plurality of methods of heating, including radio frequency, resistance, laser or vapor phase. Radio frequency is the preferred embodiment.

As will be understood by one skilled in the art, the coupling of the stripped wire ends to the signal contacts is effected by adhesion between the soldering material intermediate the wires and the signal contacts, the reflowing of the soldering material therebetween effecting the coupling. It should be further understood, that the desired coupling may be effected by a wide range of adhesive coupling techniques.

The present disclosure includes that information contained in the appended claims as well as that in the foregoing description. Although the invention has been described in its preferred forms or embodiments with a certain degree of particularity, it is understood that the present disclosure of the preferred form has been made only by way of example and that numerous changes in the details of construction, fabrication and use, including the combination and arrangement of parts and method steps, may be resorted to without departing from the spirit and scope of the invention.

What is claimed is:

1. For coupling wires of a ribbon cable with an electrical connector, the combination comprising:

signal contacts within the connector, each signal contact having a downwardly extending U-shaped slot, the bights of said slots having semicircular cross-sectional configurations about parallel horizontal axes with a common first diameter;

signal wires extending parallel with each other in the plane of a ribbon cable, said signal wires having circular cross-sectional configurations with a common second diameter less than the first diameter, said signal wires having stripped free ends with a bend in each said signal wire adjacent to its free end of less than 90 degrees from an original vertical orientation whereby the bent portion of each said signal wire may contact the bight of one said signal contact adjacent to its end remote from the plane of the ribbon cable; and material coupling each said signal wire and its associated said signal contact.

2. The combination as set forth in claim 1 wherein said material coupling each said signal wire and its associated signal contact comprises solder encompassing at least about 270 degrees of the cross-sectional area of each said signal wire.

3. The combination as set forth in claim 1 wherein the bend is about 70 degrees.

4. The combination as set forth in claim 1 wherein said signal contacts are located on opposite sides of the plane of the ribbon cable and the bends of some of said signal wires are toward said signal contacts on one side of the plane and the bends of others of said signal wires are toward said signal contacts on the other side of the plane.

5. The combination as set forth in claim 1 and further including ground wires extending downwardly from the ribbon cable between the signal wires.

6. The combination as set forth in claim 5 and further including a ground bus in the plane of the ribbon cable for receiving said ground wires.

7. The combination as set forth in claim 6 wherein said ground bus is formed as an electrically conductive U-shaped member with upwardly facing flanged ends.

8. The combination as set forth in claim 7 wherein the upper extent of said U-shaped member is adapted to be crimped over said downwardly extending ground wires.

9. The combination as set forth in claim 8 and further including soldering material coupling each said ground wire to said ground bus.

10. A connector releasably couplable with mating connector means, said connector including:

a housing fabricated of an electrically insulating material with an opening formed to receive, support, and provide strain relief to the stripped free end of a flat, multi-wire, signal transmission cable;

a plurality of spaced, parallel, electrically conductive signal contacts supported by said housing in a first plane and having their first ends within said housing and adapted to receive some wires of the received cable for signal transmission purposes, said signal contacts having second ends releasably couplable with the mating connector means; and a ground bus supported by said housing having a first end within said housing and adapted to receive others of the wires of the received cable for grounding purposes, said ground bus having a second end releasably couplable with the mating connector means, the second end of said ground bus comprising a continuous blade extending adjacent the plurality of spaced, parallel signal contacts in a second plane parallel with, but offset from, said first plane at a predetermined distance for controlling the impedance characteristics of the transmitted signals through the connector from the first ends of the ground bus and signal contacts to the second ends of the signal contacts and ground bus.

11. The connector as set forth in claim 10 wherein said signal contacts are located in two parallel first planes on opposite sides of said ground bus and said second plane with said first planes being equally spaced from said second plane.

12. The connector as set forth in claim 10 wherein said ground bus is adapted to receive every other wire of the cable for grounding purposes and the wires of the cable not received by said ground bus are adapted to be received by signal contacts.

13. The connector as set forth in claim 10 wherein said second ends of said ground bus and signal contacts extend beyond said housing for insertion into the mating connector means.

14. The connector as set forth in claim 10 and further including solder means to couple signal contacts to signal transmitting wires.

* * * * *